United States Patent [19]

Wilson

[11] Patent Number: 4,679,859

[45] Date of Patent: Jul. 14, 1987

[54] METHOD OF MAKING MOPS AND MATS IMPREGNATED WITH ANTIMICROBIAL COMPOUNDS

[75] Inventor: Charles G. Wilson, Kearney, Mo.

[73] Assignee: Golden Star, Inc., North Kansas City, Mo.

[21] Appl. No.: 791,938

[22] Filed: Oct. 28, 1985

[51] Int. Cl.[4] ..... A47L 13/20

[52] U.S. Cl. ..... 300/21; 15/104.94

[58] Field of Search ..... 8/495, 490, 624; 424/26; 15/215, 216, 217, 104.93, 104.94, 229 R, 229 AC; 300/16, 21; 546/7, 182; 162/161

[56] References Cited

U.S. PATENT DOCUMENTS

| | | | |
|---|---|---|---|
| 2,381,863 | 7/1945 | Benignus | 546/7 X |
| 2,769,006 | 10/1956 | Kalberg | 546/7 X |
| 3,971,093 | 7/1976 | Komatsu et al. | 15/104.93 |
| 4,010,511 | 3/1977 | Komatsu | 15/104.94 |
| 4,311,479 | 1/1982 | Fenn et al. | 15/104.93 X |
| 4,315,798 | 2/1982 | Bodendorf | 162/161 |

FOREIGN PATENT DOCUMENTS

| | | | |
|---|---|---|---|
| 248726 | 12/1963 | Australia | 15/104.93 |
| 2837136 | 3/1980 | Fed. Rep. of Germany | 15/104.93 |
| 305078 | 1/1929 | United Kingdom | 15/104.94 |
| 849275 | 9/1960 | United Kingdom | 546/7 |
| 1318867 | 5/1973 | United Kingdom . | |

OTHER PUBLICATIONS

Vinyzene ® Antimicrobials, Published by the Ventron Division of Morton Thiokol, Inc.

Cunilate ® 2419, Published by the Ventron Division of Morton Thiokol, Inc.

*Primary Examiner*—Mark Rosenbaum

*Attorney, Agent, or Firm*—Wm. Bruce Day

[57] ABSTRACT

Antimicrobial or bacterial static compounds are added to mops and mats to retard mildew and generally inhibit growth of undesired organisms, to prolong product life, and, to aid in reducing contamination of areas in which the mops and mats are used. For mops, an antimicrobial or bacterial static solution is set into the mop's cellulosic yarn fibers, through a heat activated setting process. In mats, the antimicrobial compound is generally incorporated into a backing, such as a vinyl plastisol based backing, used for the mats.

8 Claims, 6 Drawing Figures

Fig. 1.
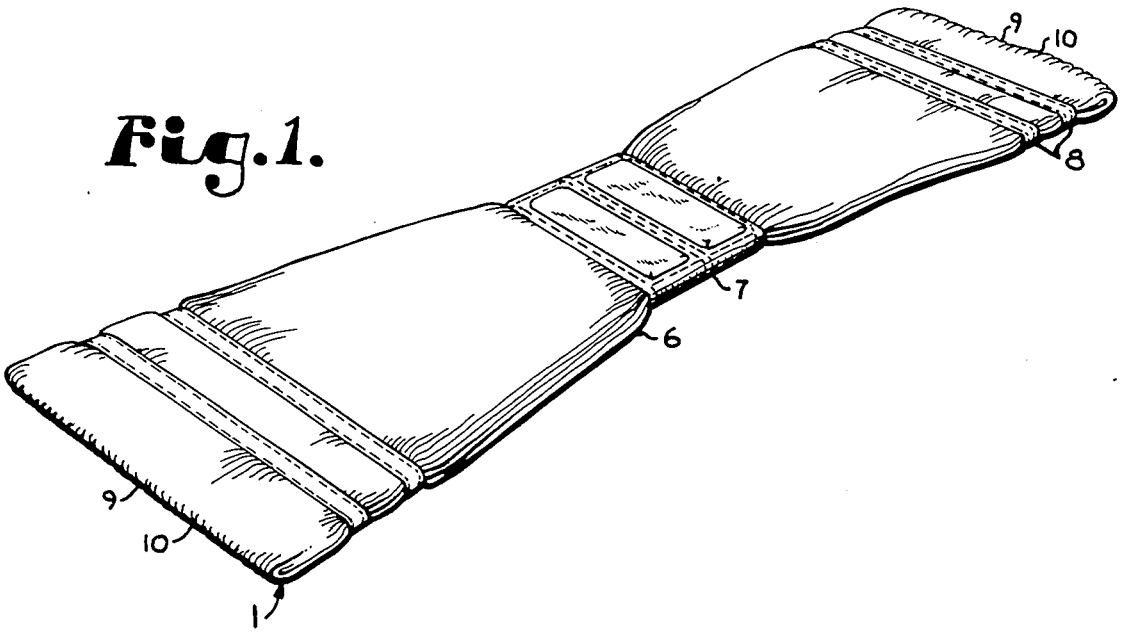
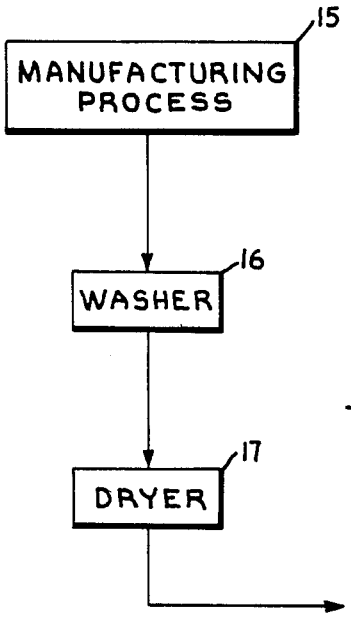
Fig. 2.

METHOD OF MAKING MOPS AND MATS IMPREGNATED WITH ANTIMICROBIAL COMPOUNDS

FIELD OF THE INVENTION

The present invention relates to dust control products such as mops and mats, and, in particular, the present invention relates to a method of making such mops and mats which are: relatively mildew and rot resistant; generally microbial static; generally useful in preventing the growth or culturing of microorganisms in their proximity; helpful in preventing subsequent transfer of microbes throughout the work place; and which are of a relatively extended useful life expectancy.

BACKGROUND OF THE INVENTION

Dust control products are generally designed to collect dust, dirt, soil and other particulate matter by either: wiping or mopping dirty surfaces, such as floors; or, by serving as entrance mats upon which people wipe their feet as they enter buildings, vehicles or certain rooms. In the case of mats, such as floor mats, since the mats are usually placed just inside an entrance to a building or vehicle, people often wipe their wet or muddy feet on the mat. The mats, especially once damp and being situated in the warm interior of the building or vehicle, provide a good environment for breeding bacteria, fungi or various other microorganisms or microbes.

With respect to mops, whether dry dust mops or wet mops, as the mops are moved over floor, wall, counter or furniture surfaces, they may become contaminated with materials which provide a good medium for growth of undesirable organisms, such as harmful bacteria. This is particularly likely to be a problem with wet mops, since they are often stored while still damp and in relatively warm places. Also, during scrubbing, contaminated mops and mats can spread such undesired bacteria.

If, prior to storage, a used mop receives only a cursory cleaning, then, while they are stored, considerable microorganism growth may occur in the mop strands or fibers. When the mop is reused, it may then provide a further means of facilitating spreading of the microorganisms around the workplace and may thereby undesirably lead to the spread of disease, infection or contamination.

Further, the growth of microorganisms in mop or mat fibers, such as through mildewing, can significantly decrease the useful life of the mop or mat because the microorganism or microbial growth may tend to degrade the strength of the fibers of the mop yarns and/or carpet or yarn material utilized. Also, a mop swab attacked by mildew formation may smell sour and the odor may spread throughout the cleaning supplies in the storage room. This may be a particular problem in restaurants where the mops are often stored in the same room as tablecloths, various paper products and napkins. Under such circumstances, the presence of the contaminated mop, in close proximity to the other items, may actually lead to the development of a sour odor in the other stored items.

With respect to mats, it is noted that the floor surface underneath the mats may be a particularly good location for the breeding of undesirable microbes, since it is often warm, and wet, and is in close proximity to materials trapped in carpet fibers of the mat. It is believed that microbial development, in and near the mat, not only is unsanitary, but it may, in some instances, lead to discoloration of the floor surface underneath the mat.

The problems noted above have long been known to the mop and mat industry, and it is common practice for persons utilizing mops to add solutions that contain disinfectants or antimicrobial compounds to solutions used in mop buckets. In the case of mats, it is a known practice to soak the mats in disinfectant solutions prior to or commensurate with mat cleaning.

The above related techniques suffer from a general failure to impart a semi-permanent antimicrobial quality to the mop or mat; for example, such solutions may be easily rinsed out with successive washings of the mop or mat product.

The present invention comprises a method developed to generally alleviate many of the aforementioned problems. Generally, the invention relates to the provision of a bacterial static or antimicrobial compound which is set into the mop or mat during the manufacturing process. The bacterial static or antimicrobial compound, being retained within portions of the mop or mat, will generally not be readily leached during washings. In this manner, the compounds remain in the proximity of the yarn fibers of the mop or mat, where they can generally inhibit bacteria or other microbial growth. Further, such compounds generally provide a zone of inhibition to microbial growth, extending outwardly around the substrate in which the compounds are set. Thus, they will generally aid in inhibiting bacterial or other microbial growth in the general proximity of the yarn or mat product.

When the invention is applied to mats, an antimicrobial or bacterial static solution is added to a base material, such as a plastisol or rubber compound, which will eventually comprise a backing or floor-engaging portion of the mat. When the plastisol or rubber material is fused, or set, the antimicrobial or bacterial static compound is generally retained within the backing and effectively acts from that location.

With respect to the application of the invention for mops, generally the antimicrobial or bacterial static compound is heat set into the mop yarn fibers. This process generally leads to the retention of an antimicrobial effective concentration of the compound in the yarn fibers, even after repeated washings of the mop. It is foreseen that, in some instances, it may be desirable, in mops having some synthetic yarn fibers, to have set the antimicrobial or bacterial static compound into synthetic mop yarns as they are formed. This latter would be by a procedure generally analogous to that utilized for a mat backing.

As indicated above, application of the invention to mops or mats generally significantly enhances the life of the mat or mop product. This may result from a substantial inhibitory effect of the presence of the antimicrobial or bacterial static compound, in proximity to the cellulosic yarn fibers, upon growth of fiber destroying bacteria or microbes. Since microbial growth is substantially inhibited, the yarn fibers of the mat or mop product last considerably longer, and the mat or mop has a longer useful life. Further, certain types of spreading of bacterial- or fungal-type infections may be substantially reduced, if not eliminated, by the utilization of such antimicrobial-enhanced mop and mat products.

OBJECTS OF THE INVENTION

The principal objects of the present invention are: to provide a mop or mat product having increased resistance to mildew and rot, in order to extend the useful life of such mop or mat products; to provide a mat product which is impregnated with a bacterial static or antimicrobial compound, such that a zone of inhibition of such compounds, to microbial growth, generally inhibits microbial growth in such mats or in or near areas contacted by, or in contact with, such mats; to provide a mop product which is impregnated with a bacterial static or antimicrobial compound, in cellulosic yarn fibers of the mop; to provide mop or mat products with an enhanced lifetime with respect to yarn fibers thereof; to provide mop or mat products impregnated with antimicrobial or bacterial static compounds which are not relatively easily leached therefrom and which generally provide antibacterial or antimicrobial action substantially through an entire, extended, lifetime of the product; and to provide methods of producing such products which are relatively inexpensive, and relatively easy to effect.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the invention and illustrate various objects and features thereof. In some instances material thickness may be exaggerated, or shown in reduced size, relative to other portions of a depicted structure, for clarity.

DESCRIPTION OF THE DRAWINGS

FIG. 1 is a perspective view showing a mop swab.

FIG. 2 is a schematic view of steps of manufacturing a mop swab impregnated with an antimicrobial compound, according to the present invention.

DESCRIPTION OF THE PREFERRED EMBODIMENT

Figure 3:
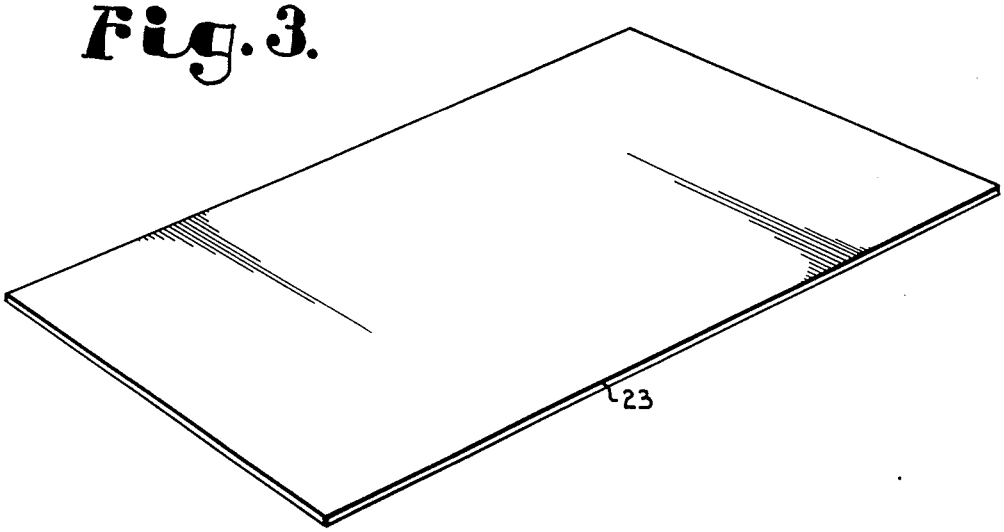
FIG. 3 is perspective view showing a film or sheet of material utilized in preparing a mat according to the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but rather merely as a basis for the claims and as a representative basis for teaching one skilled in the art to variously employ the present invention in virtually any appropriately detailed structure.

Referring to the drawings in more detail:

The present invention relates to methods for the production of dust control products, such as mops or mats, appropriately impregnated with bacterial static or antimicrobial compounds, in order to generally inhibit microbial growth in and around the mop or mat product. With respect to the drawings, FIGS. 1 and 2 relate to application of the present method to mops; and FIGS. 3, 4, 5 and 6 relate to application of the present invention to mats, such as floor mats. First, application of the present invention in mops is described.

Reference numeral 1, FIG. 1, generally refers to a mop swab which has been or may be impregnated with an antimicrobial or bacterial static compound according to the process generally outlined in the scheme of FIG. 2. The mop swab 1 of FIG. 1 is for utilization as a wet mop, however it will be understood that the present invention may be readily and analogously applied to dust mops or mops which are intended to be used when generally dry. With respect to the mop swab 1, the antibacterial or antimicrobial compound is set into the mop fibers through a heat setting process. The presence of the bacterial static or antimicrobial compound will generally inhibit microbial growth in and near the mop fibers. As used herein, the term "bacterial static compound" generally refers to any appropriate compound which exhibits a propensity to inhibit growth of bacteria. The term "antimicrobial compound" generally refers to any compound which exhibits a propensity to inhibit growth of microorganisms or microbes of various types. Generally speaking bacterial static compounds would also be antimicrobial compounds. Antimicrobial compounds would also include such compounds as fungicides or similar acting compounds.

Referring again to FIG. 1, the mop swab 1 is composed of a plurality of side by side yarns 6, each composed of a multiplicity of yarn fibers. Generally, these fibers are a natural or synthetic cellulosic material, or a combination of both. For example, many mop swabs are composed of cotton, while others are composed of synthetic fibers such as rayon, saran, orlon or similar materials. Also, in many mop swabs synthetic fibers are utilized in combination with cotton fibers. Cellulosic fibers are believed to be preferable for use with the methods of the present invention, as the antimicrobial compounds generally readily heat set with them.

For the particular mop swab 1 shown, the yarns 6 are formed into a swab 1 having a conventional head band 7, facilitating connection of the swab 1 to a mop stick (not shown). Such swabs 1 generally also include tail bands 8. In the mop swab 1 depicted, two tail bands 8 are used adjacent each end 9 of the swab 1 and maintain ends 10 of the yarns 6 in an outwardly spread, or fanlike, configuration.

The natural and synthetic cellulosic fibers generally employed in the mop yarns 6, are subject to infestation and attack by microbes such as fungi or bacteria when the mop swab 1 is used to scrub a dirty area, such as a restaurant floor, a factory floor, or, perhaps especially in the instance of dust mops, certain furniture, wall, counter, or window surfaces. The mop yarns 6, during this cleaning, may become contaminated with agents, such as food agents, that may provide good support for breeding bacteria, fungi, or similar organisms. Often, when mops, particularly wet mops, are stored they are put away in a damp condition and retained in a dark warm area, where any organisms contained in the yarns 6, particularly in proximity to trapped food material, may quickly proliferate. When such a mop is reused, it may then facilitate the spread of such microorganisms about the work place or area mopped.

This latter can be a particular problem in hospitals, where mops such as floor mops are sometimes subjected to very hazardous, and sometimes even deadly, microorganisms. When mops are used a multiplicity of times in hospitals, they may spread these organisms to otherwise clean areas, thereby also contaminating that area. Similarly, in food processing plants and restaurants potentially deadly bacteria, such as certain staphylococcus or the like, may proliferate, spread and ultimately contaminate food stuffs.

It is evident that generally inhibiting such microbial growth and spread, through the use of mops, is of significant importance and is a substantial problem. To aid in solving this problem, a bacterial static or antimicrobial compound is set into fibers of the mop swab 1.

To set a desired antimicrobial compound into the mop swab 1, the constructed swab 1 is taken, following the manufacturing process 15, FIG. 2, and is placed in an agitator or washer tank 16 which contains a solution of the desired growth inhibiting compound. It is believed that a large variety of bacterial static or antimicrobial compounds, generally referred to herein as inhibitory compounds, may be utilized according to the present invention. However, a preferred inhibitory compound for general use, where mops are likely to be used, is an antimicrobial compound comprising a copper salt of an organic substance possessing antimicrobial activity. In particular, the substance copper 8-quinolinolate has been found effective. Preferably the copper 8-quinolinolate is available in a non-ionic emulsion concentrate. Such a concentrate, containing 10% solubilized copper 8-quinolinolate, is commercially available from the Ventron division of Morton Thiokol Corporation, under the trade name of CUNILATE 2419. Preferably, a 3% aqueous mixture of the 10% copper 8-quinolinolate emulsion is added to the washer 16 and a mop swab 1 is retained in the washer 16 until it is generally saturated with the solution of inhibition compound. The mop swab 1 may then be removed from the washer 16, and any excess solution may be extracted, such as by wringing or by spinning in a centrifuge extractor. In the preferred embodiment, FIG. 2, the agitator or washer tank 16 includes a spinner or centrifuge extractor or extraction mechanism, as is common in a commercial washer. The swab 1, following extraction, is then placed in a hot air dryer 17.

Preferably, a mop swab 1 which has been saturated with the inhibitory compound solution is maintained in the dryer 17 at an appropriate temperature for a time period, sufficient to set the inhibitory compound into the fibers, which, for copper 8-quinolinolate has been found to be at about 160° Fahrenheit for at least twenty (20) minutes. This hot air drying cycle sets the antimicrobial solution into the cellulosic mop fibers, so that the solution is not readily washed out of the mop 1 as the mop swab 1 is used thereafter. That is, the swab 1 may be utilized as a wet mop, with repeated washings or rinsings, without significant leaching of the inhibitory compound, preferably copper 8-quinolinolate, from the yarn fibers. It will be understood that different inhibitory compounds may require different temperatures or setting times.

Tests indicate that the inhibitory compound, preferably the copper 8-quinolinolate agent, remains present in sufficiently substantial quantities to generally retard the growth of various microorganisms for a period of up to fifty washings after being set into the mop swab 1. The typical life of a mop swab 1 is approximately twenty-five to thirty relatively harsh washings, before substantial breakdown in the structural integrity of the yarns 6 of the swab 1 occurs. Thus, the antimicrobial compound is substantially effective throughout the lifetime of the mop. Further, since mop yarns impregnated with the inhibitory compound will be more resistant to mildew and rot, which decrease a mop's useful life by destroying yarn fibers, the method previously described may result in a substantial extension of the useful life expetency of a typical mop swab 1.

Many mats, such a floor mats, generally comprise a carpet nap or plurality of fibers extending outwardly from a backing such as a plastic or rubber. Such mats can collect moisture and food material for the growth of bacteria, various fungi, or similar organisms. An alternate embodiment of the present invention comprises a method for impregnating such mats in order to generally inhibit bacteria growth, or the growth of similar organisms. In this application, the inhibitory compound is introduced into the mat during its manufacture. This will be generally understood by reference to FIGS. 3 through 6.

Figure 4:
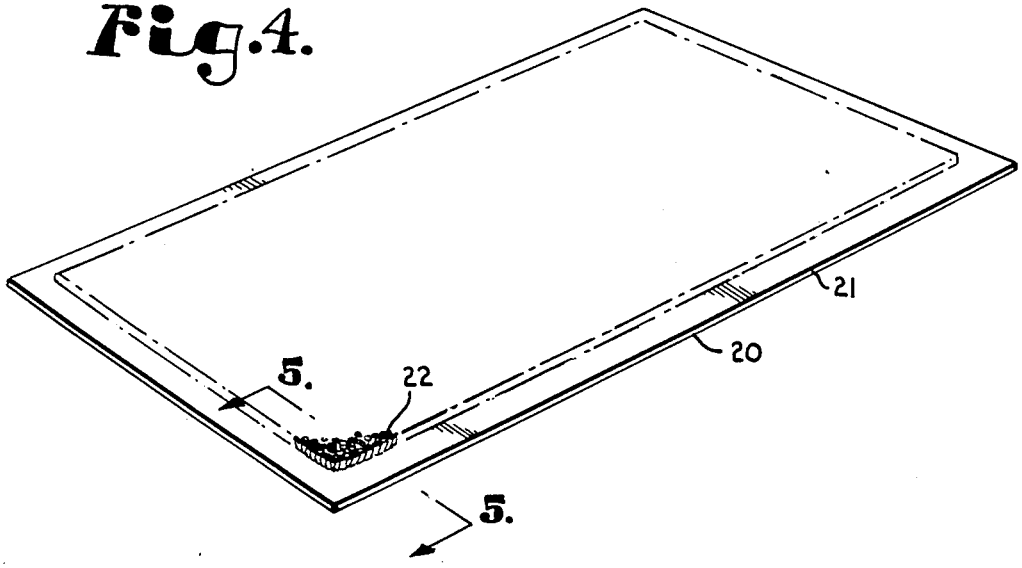
FIG. 4 is a perspective view illustrating a mat constructed according to the present invention.

Referring to FIG. 4, a mat 20 generally comprises a backing 21 having a plurality of yarns such as carpet yarns 22 extending outwardly therefrom. Generally, the backing 21 may be comprised from a plurality of materials, which are "fixed" from a fluid, pseudo-liquid, or free flowing state to a somewhat solid, non-free flowing state. For example, the backing 21 may comprise a plastisol, which has been fused, or a rubber which has been set, or some other polymer-type substance which has been cured. The term "fixed" as used herein will refer to the process of substantially hardening or firming the backing substance 21 whether it be by chemical or physical means, for example curing, fusion, setting or the like.

Again, while a variety of substances may be utilized to form the backing 21 according to the present invention, in the preferred embodiment, the backing 21 comprises a fused vinyl plastisol. During preparation of the mat 20, a sheet or film 23, FIG. 3, of the plastisol, while in a fluid, pseudo-liquid, non-fused, or non-fixed state is formed. Yarn fibers or carpet material are then set upon, or partially in, the film 23 of plastisol material, which is then fused to form the mat product. It is noted that the film 23 need not be rectangular as shown in FIG. 3, and can be trimmed, as desired, following fixing.

Figure 6:
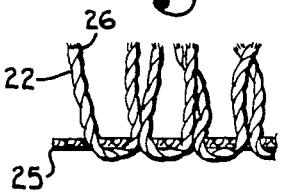
FIG. 6 is an enlarged, fragmentary, sectional view of a portion of the mat generally shown in FIG. 5.
Figure 5:
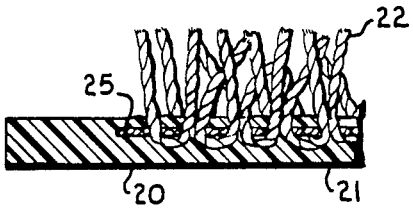
FIG. 5 is an enlarged, sectional view, taken generally along lines 5—5 of FIG. 4.

Preferably, the carpet material utilized is in a form generally referred to in the industry as "greige" goods. Referring to FIG. 6, this material generally comprises a sheet of flexible fabric 25 having a plurality of yarn loops or tufts 26 therein, and extending upwardly therefrom. This sheet of fabric 25 containing the yarn loops 26 is set upon the non-fixed film 23, during mat manufacture. The film material, FIG. 5, while still in a non-fixed or somewhat fluid state, will partially permeate and engulf the fabric 25 and yarn loops 26. When the film 23 is fixed or hardened, a typical, conventional, mat 20 results.

While the fiber segments or yarn loops 26 may comprise a variety of materials, normally for floor mats use of a durable carpet nap material such as nylon is often preferred.

Again, mats containing a carpet nap material may become partially or substantially dirt and moisture saturated, and may provide good breeding grounds for various fungi, bacteria or other organisms. To combat growth of such organisms, in or near the mat, an inhibitory compound such a bacterial static compound or antimicrobial compound is added to the film 23 prior to "fixing". Then when the sheet or film 23 is fixed, to form the mat 20, it is substantially fully impregnated with the inhibitory compound. Further, the yarn loops 26 may act as wicks and absorb some of the antimicrobial compound during fixing. It has been found that the inhibitory compound does not readily leach from the backing 20, after fixing.

While it is foreseen that a variety of compounds may be utilized as inhibitory compounds in the film 23, it is found that when the film 23 is a vinyl plastisol, a preferred antimicrobial compound is 10,10'-oxybisphenoxarsine (OBPA). A preferred concentration of the 10,10'-oxybisphenoxarsine is a 1.5% mixture, by volume, with the vinyl plastisol compound to form a backing forming mixture. 10,10'-oxybisphenoxarsine is commercially available under the trademark VINYZENE and is obtainable through the Ventron Division of MORTON THIOKOL, Inc. in Danvers, Mass. It is found that when 10,10'-oxybisphenoxarsine is utilized in a backing forming mixture with the vinyl plastisol, it becomes substantially incorporated therein, and is ultimately retained in the fixed backing sheet 21.

The presence of the inhibitory compound generally inhibits microorganism growth in or near the carpet backing, including a zone of inhibition which includes much of the upwardly extending yarn fibers 22. As a result, the useful life of the mat product may be substantially increased, and microorganism control in and around the mat is substantially facilitated. Further, fixation may lead to some setting of the antimicrobial compound in the yarn fibers 22, by a wicktype action, further facilitating microorganism control.

It will be understood that the appropriate method of setting or fixing the film 23 in order to form the mat 20, will in part depend upon the material selected for the backing 21. Generally, vinyl plastisol is heat fused in an oven after the greige goods have been applied thereto. In the case of certain rubber or plastic backings, heat or light initiated polymerization may be necessary.

It will be understood that a method similar to that utilized for introduction of an inhibitory compound into the backing 21 of a mat 20, might be utilized to introduce an inhibitory compound directly into almost any synthetic fibers of any portion of either the mop or mat. A method of achieving this would be to mix an appropriate antimicrobial or inhibitory compound with a resin mixture from which the synthetic fibers are formed. The synthetic fibers would then be formed "charged" or impregnated with the antimicrobial, and yarns made from those fibers would be antimicrobial active.

It is also foreseen that a method of setting an antimicrobial compound into yarn fibers, similar to that described above for mop fibers, might be utilized on the yarn fibers of the greige goods used to create the mat 20. In this manner, not only the backing 21, but also the yarns 26 of the mat 20 can be substantially fully impregnated with an antimicrobial compound. Further, the methods of the present invention are foreseen to be readily adoptable to numerous dust or dirt control products including various types of pads having material collecting yarns or plastisol or rubber backings.

It is to be understood that while certain forms of this invention have been illustrated and described herein, it is not to be limited to the specific form or arrangement of features or steps herein described and shown, except in so far as such limitations are included in the following claims.

What is claimed and desired to be secured by Letters Patent is as follows:

1. A mop swab having antimicrobial activity and comprising:
(a) an assemblage of yarns of cellulosic fibers;
(b) said yarns being formed into a mop swab; and
(c) said mop swab being impregnated with an organic copper salt bonded to said cellulosic fibers and having an antimicrobial activity.

2. A mop swab having antimicrobial activity and comprising:
(a) an assemblage of yarns of cellulosic fibers;
(b) said yarns being formed into a mop swab; and
(c) said mop swab being impreganted with copper 8-quinolinolate bonded to said cellulosic fibers and having an antimicrobial activity.

3. A mop swab having antimicrobial activity and comprising:
(a) an assemblage of yarns of cellulosic fibers;
(b) said yarns being formed in a mop swab; and
(c) said mop swab being impregnated with an organic copper salt material wherein said copper salt material is set into said fibers for retention therein for a substantial number of washings and maintaining the antimicrobial activity of said mop swab.

4. A mop swab having antimicrobial activity and comprising:
(a) an assemblage of yarns of cellulosic fibers;
(b) said yarns being formed into a mop swab; and
(c) said mop swab being impregnated with a copper 8-quinolinolate wherein said copper 8-quinolinolate is set forth into said fibers for retention therein for a substantial number of washings and maintaining the antimicrobial activity of said mop swab.

5. A process of producing a mop swab having antimicrobial activity, said process including the steps of:
(a) providing an assemblage of yarns of cellulosic fibers;
(b) forming said yarns into a mop swab;
(c) substantially saturating said mop swab with a inhibitory compound comprising a solution of copper 8-quinolinolate;
(d) extracting said solution from said mop swab, leaving said mop swab damp; and
(e) hot air drying said mop at a sufficient temperature and for a period of time sufficient to set said inhibitory compound into said fibers.

6. The process of producing a mop swab set forth in claim 5 wherein:
(a) drying said mop at a temperature of approximately 160 degrees Fahrenheit; and
(b) said peried of time is approximately twenty minutes.

7. A process of producing a mop swab having antimicrobial activity, said process including the steps of:
(a) providing an assemblage of yarns of cellulosic fibers;
(b) forming said yarns into a mop swab;
(c) substantially saturating said mop swab with a inhibitory compound comprising a solution of a copper salt of an organic compound which possesses antimicrobial activity;
(d) extracting said solution from said mop swab, leaving said mop swab damp; and
(e) hot air drying said mop at a sufficient temperature and for a period of time sufficient to set said inhibitory compound into said fibers.

8. The process of producing a mop swab set forth in claim 7 wherein:
(a) drying said mop at a temperature of approximately 160 degrees Fahrenheit; and
(b) said period of time is approximately twenty minutes.

* * * * *